US007431354B2

(12) United States Patent
Raatikainen

(10) Patent No.: US 7,431,354 B2
(45) Date of Patent: Oct. 7, 2008

(54) ARRANGEMENT FOR GUIDING THE DEADLOCKING OF A LATCH BOLT IN A DOOR LOCK

(75) Inventor: Juha Raatikainen, Joensuu (FI)

(73) Assignee: Abloy Oy, Joensuu (FI)

( * ) Notice: Subject to any disclaimer, the term of this patent is extended or adjusted under 35 U.S.C. 154(b) by 272 days.

(21) Appl. No.: 10/553,295

(22) PCT Filed: Apr. 27, 2004

(86) PCT No.: PCT/FI2004/000255

§ 371 (c)(1),
(2), (4) Date: Oct. 14, 2005

(87) PCT Pub. No.: WO2004/102007

PCT Pub. Date: Nov. 25, 2004

(65) Prior Publication Data

US 2007/0096475 A1 May 3, 2007

(30) Foreign Application Priority Data

May 14, 2003 (FI) ..... 20030719

(51) Int. Cl.
*E05C 1/02* (2006.01)
*E05B 59/00* (2006.01)

(52) U.S. Cl. ..... 292/137; 292/169; 70/107; 70/277

(58) Field of Classification Search ..... 292/137, 292/169, 169.13, 169.14; 70/107–111, 277
See application file for complete search history.

(56) References Cited

U.S. PATENT DOCUMENTS

| | | | | |
|---|---|---|---|---|
| 5,083,448 | A * | 1/1992 | Karkkainen et al. | 70/277 |
| 5,113,676 | A | 5/1992 | Panossian | |
| 6,125,670 | A * | 10/2000 | Fuss et al. | 70/107 |
| 6,302,456 | B1 * | 10/2001 | Errani | 292/332 |
| 2006/0123859 | A1 * | 6/2006 | Gonzalez | 70/107 |
| 2007/0051143 | A1 * | 3/2007 | Raatikainen et al. | 70/107 |

FOREIGN PATENT DOCUMENTS

| | | |
|---|---|---|
| DE | 3938655 | 5/1990 |
| DE | 19626745 | 10/1997 |
| DE | 19858174 | 6/2000 |
| EP | 1031686 | 8/2000 |
| FI | 83802 | 5/1991 |
| WO | 02066774 | 11/2006 |

* cited by examiner

*Primary Examiner*—Carlos Lugo
(74) *Attorney, Agent, or Firm*—Smith-Hill and Bedell

(57) ABSTRACT

A door lock includes a latch bolt and an auxiliary bolt. A stop member is supported by the auxiliary bolt and is movable relative to the auxiliary bolt between a position in which it prevents a guide element moving to a position providing deadlocking of the latch bolt, while the auxiliary bolt is in a protruding position, and a position in which it allows the guide element to move to a position providing the deadlocking of the latch bolt. The stop member allows the guide element to move to the position providing deadlocking of the latch bolt only in case both the auxiliary bolt and the latch bolt are first moved to retracted positions.

16 Claims, 8 Drawing Sheets

ARRANGEMENT FOR GUIDING THE DEADLOCKING OF A LATCH BOLT IN A DOOR LOCK

This is a national stage application filed under 35 USC 371 based on International Application No. PCT/FI2004/000255 filed Apr. 27, 2004, and claims priority under 35 USC 119 of Finnish Patent Application No. 20030719 filed May 14, 2003.

The invention relates to an arrangement for guiding the deadlocking of a latch bolt in a door lock.

A door lock provided with a latch bolt and an auxiliary bolt of the type discussed herein is disclosed in the Finnish patent specification FI 83802 C. The deadlocking of the latch bolt in this kind of door locks is accomplished simply by pressing the auxiliary bolt into the lock case. Normally this takes place when the door is being pushed to a closed position, whereby also the auxiliary bolt, in addition to the latch bolt itself, is retracted into the lock case urged by the doorframe and the striker plate thereon. When the door is in the closed position the latch bolt extends out into the opening in the striker plate of the lock, but the striker plate prevents the protrusion of the auxiliary bolt until the deadlocking of the latch bolt is released and the door is opened again. The deadlocking may be released in a way known per se, for instance by a door handle on the inside of the door, by a key, or by electrical remote control.

When the door is open, both the latch bolt and the auxiliary bolt are in their protruding positions in the above-discussed lock. If the auxiliary bolt is then pressed into the lock case either by accident or in case of misbehaviour, it activates simultaneously the deadlocking of the latch bolt, whereby the door cannot be closed simply by pushing, but one of the above-mentioned ways to release the deadlocking needs to be applied. Depending on the situation this can be fairly difficult, especially if the door is a public door used in daytime and in addition, it is electrically remote-controlled, whereby the signal reporting the malfunction is not necessarily immediately transmitted further.

An object of the invention is to provide a novel arrangement, the construction of which is as uncomplicated and reliable as possible and by means of which the above-described malfunction can be eliminated efficiently.

According to the invention the arrangement includes members which are arranged so as to allow the moving of a guide element to a position providing the deadlocking of the latch bolt only in case both the auxiliary bolt and the latch bolt are first moved to their retracted positions. Thus the pressing of the auxiliary bolt in is not alone enough for activating the deadlocking of the latch bolt, but it will take place only after the door has been pushed to its closed position and both the latch bolt and the auxiliary bolt are retracted into the lock case urged by the door frame.

In a preferred practical embodiment said members include a separate stop member supported movably by the auxiliary bolt, which stop member is arranged to act upon the guide element, for instance a protrusion in it, so that it prevents the moving of the guide element to its position providing the deadlocking of the latch bolt, when the auxiliary bolt is in its protruding position. Thus said stop member can with advantage be arranged to be moved to a position, where it allows the moving of the guide element to a position providing deadlocking of the latch bolt. In order to secure the operation of the stop member it is urged by spring to its said position allowing the moving of the guide element.

The auxiliary bolt is preferably provided with a guiding piece attached to the lock case, which guiding member defines the freedom of movement of the stop member and is arranged to guide the movements of the auxiliary bolt. The stop member preferably comprises a guiding edge, which is in cooperation with the guide element and is turnable relative to said guiding piece. The guiding piece comprises wedge-shaped guide surfaces for the stop member, whereby they preferably define the turning freedom of the stop member.

The protrusion of the guide element is with advantage provided with a recess, where the stop member is normally located so that it prevents said turning movement of the stop member, while the latch bolt and the auxiliary bolt are in their protruding positions. Thus no separate stoppers are required for guiding the operation of the stop member itself.

The latch bolt may be provided with a guide surface, which is arranged to move the guide element so as to release the stop member from the impact of said recess, when the latch bolt is being pressed into the lock case. In a preferred practical embodiment said guide surface may be connected to the deadlocking member of the latch bolt, which member the guide element is arranged to act upon in order to accomplish deadlocking of the latch bolt.

The invention may preferably be applied to a lock case, which has also a dead bolt, just as is disclosed in the above-mentioned patent specification FI 83802 C. In that case said guide element is preferably arranged to guide also the movements of the dead bolt.

In the following the invention is described by way of example with reference to the attached drawings, in which FIG. 1 is a side view of an arrangement according to the invention with an opened lock case in a situation where both the latch bolt and the auxiliary bolt are in their protruding positions;

Figure 1:
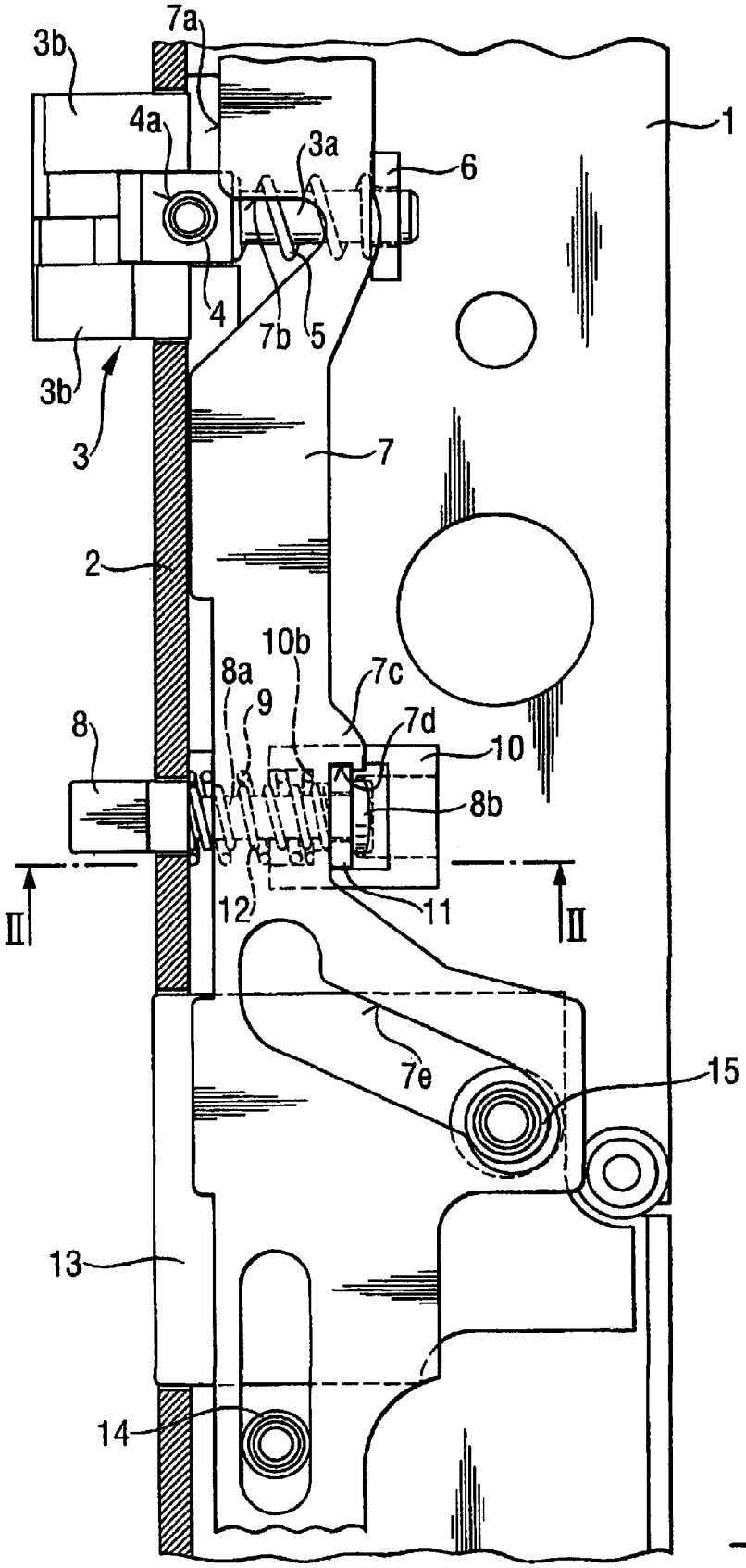

In the drawings the reference numeral 1 indicates a lock case to be installed in a door or the like, which lock case is provided with a front plate 2, and has a latch bolt 3 and an auxiliary bolt 8 as well as a guide element 7 operatively connected to these. In the embodiment according to the figures the lock case is further provided with a dead bolt 13, which is conventional as such, but the invention may be applied independently of the dead bolt.

The latch bolt 3 is of the type that it enables the opening and closing of the door without separate operational means so that the latch bolt is pressed to its retracted position in the lock case, when either wedge side of the tapering wedge-shaped end of the latch bolt protruding from the lock case hits the striker plate of the lock on the door frame. The latch bolt 3 according to the shown embodiment comprises a body part 3*a*, by which two separate wedge-shaped headpieces 3*b* are pivotably supported. This is similar to the construction shown in more detail in the patent specification FI 83802 C.

The latch bolt 3 is by means of a spring 5 urged to its position protruding from the lock case and the lock case is provided with a stopper 6 for the spring 5. The latch bolt 3 has also a deadlocking member 4, which is in cooperation with the guide surface 7*a* of a guide element 7 in order to accomplish deadlocking. The guide surface 4*a* of the deadlocking member 4 is in cooperation with a counter surface 7*b* of the guide element, as is described in more detail below.

Figure 7:
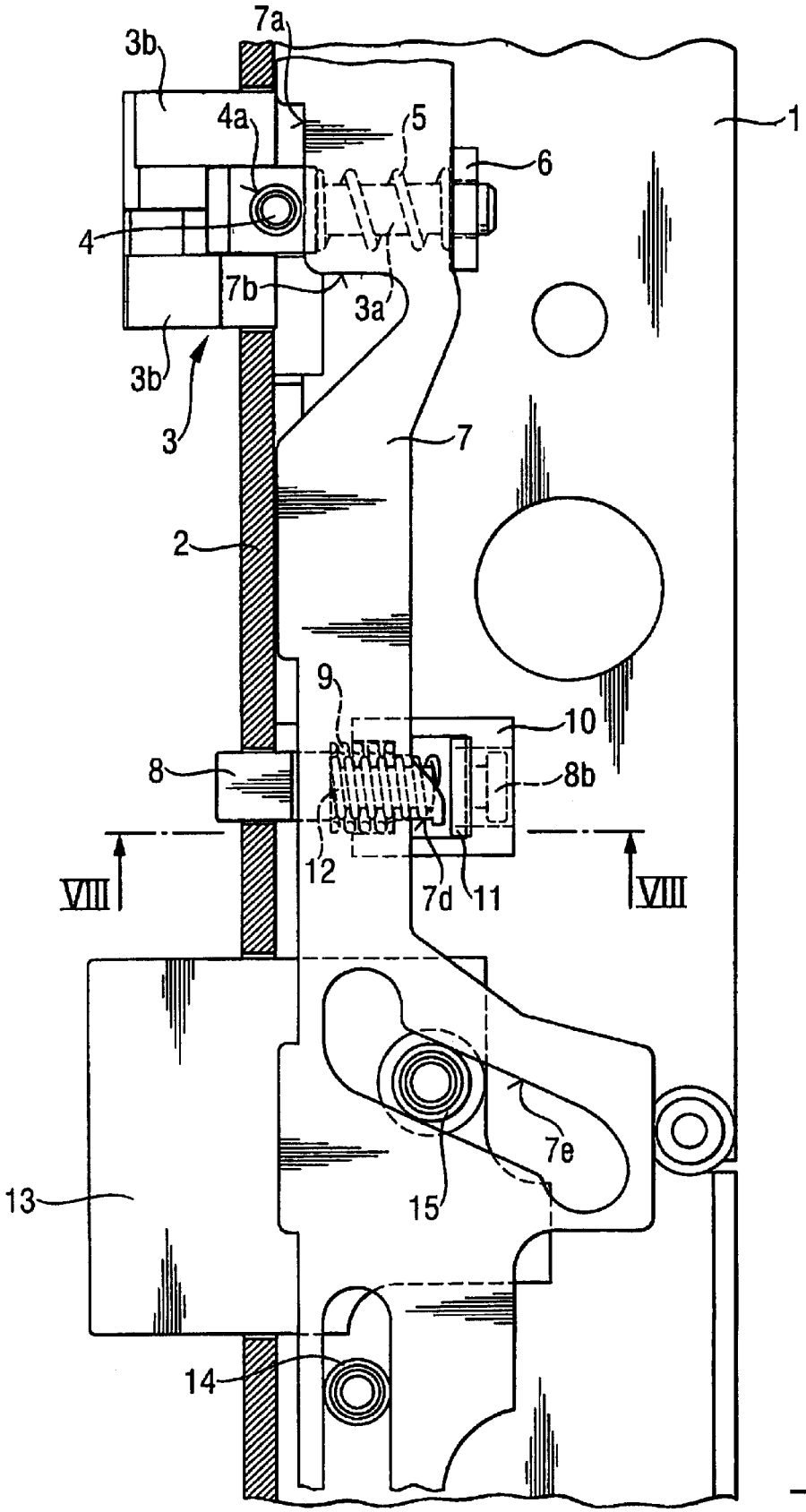
FIG. 7 shows the arrangement according to FIG. 1 corresponding the closed position of the door, where the latch bolt is in a protruding position and the auxiliary bolt is in a retracted position in the lock case.

The guide element 7 may be moved in the direction of the front plate 2 and the lock case is provided with relevant guiding members for guiding its movements, of which members a pin 14 is shown in FIGS. 1 and 7. The guide element 7 also comprises a protrusion 7*c* provided with a recess 7*d*, and a guide groove 7*e*, which is in cooperation with a pin 15 of the dead bolt 13 for guiding the movements of the dead bolt.

The auxiliary bolt 8 includes a body part 8*a* and a guide part 8*b*, which is in cooperation with a guiding piece 10 attached to the lock case. The auxiliary bolt 8 is by means of a spring 9 urged to, its protruding position and the spring 9 is also supported to a counter surface 10*b* in the guiding piece 10. In addition, the arrangement comprises a stop member 11, which is movably supported by the body part 8*a* of the auxiliary bolt and pressed by a spring 12 toward the lock case. The auxiliary bolt 8 may on one hand move relative to the stop member 11 and on the other hand the stop member is turnable relative to the body part 8*a* of the auxiliary bolt. Guide surfaces 10*a* of the guiding piece 10 define the turning freedom of the stop member 11.

Figure 2:
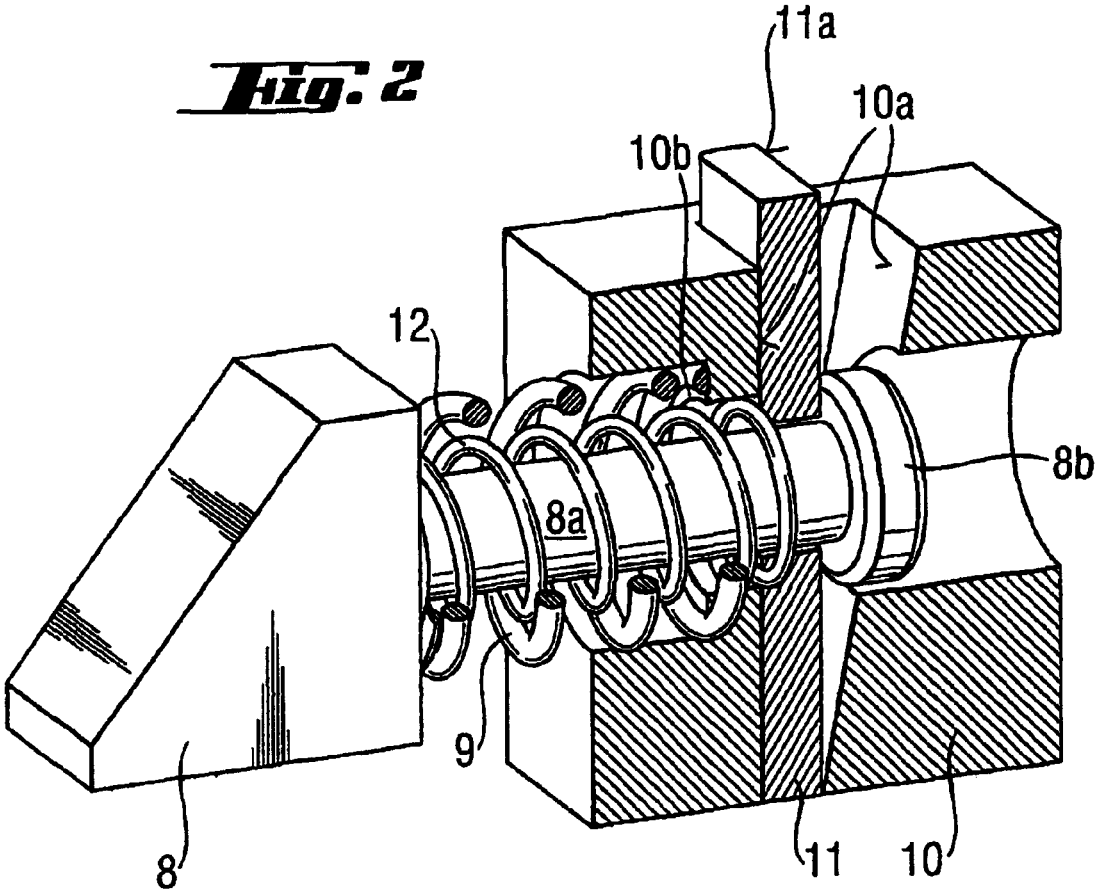
FIG. 2 shows a partial enlargement of FIG. 1, partly in section, and as perspective view taken on line II-II.

The operation of the arrangement is as follows. In the situation according to FIGS. 1 and 2, where the latch bolt 3 and the auxiliary bolt 8 are out, which corresponds to the open position of the door, the stop member 11 is in the recess 7*d* of the guide element, whereby it prevents the guide element 7 from moving downwards in the figures to a position deadlocking the latch bolt 3. At the same time the recess 7*d* prevents the stop member 11 from turning away from this position in spite of the loading caused by the spring 12.

Figure 3:
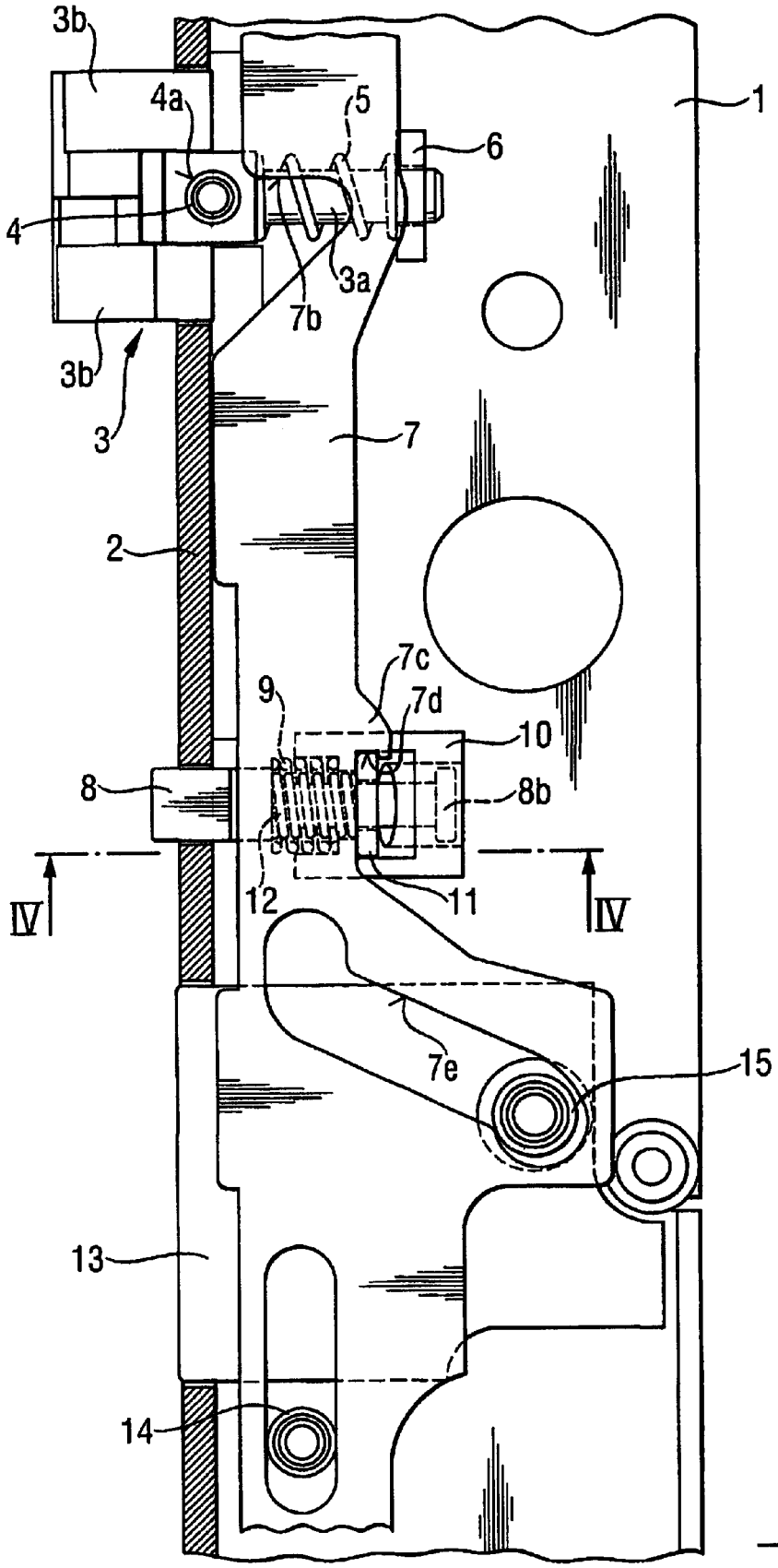
FIG. 3 shows the arrangement according to FIG. 1 in a situation where the auxiliary bolt is in a retracted position in the lock case.
Figure 4:
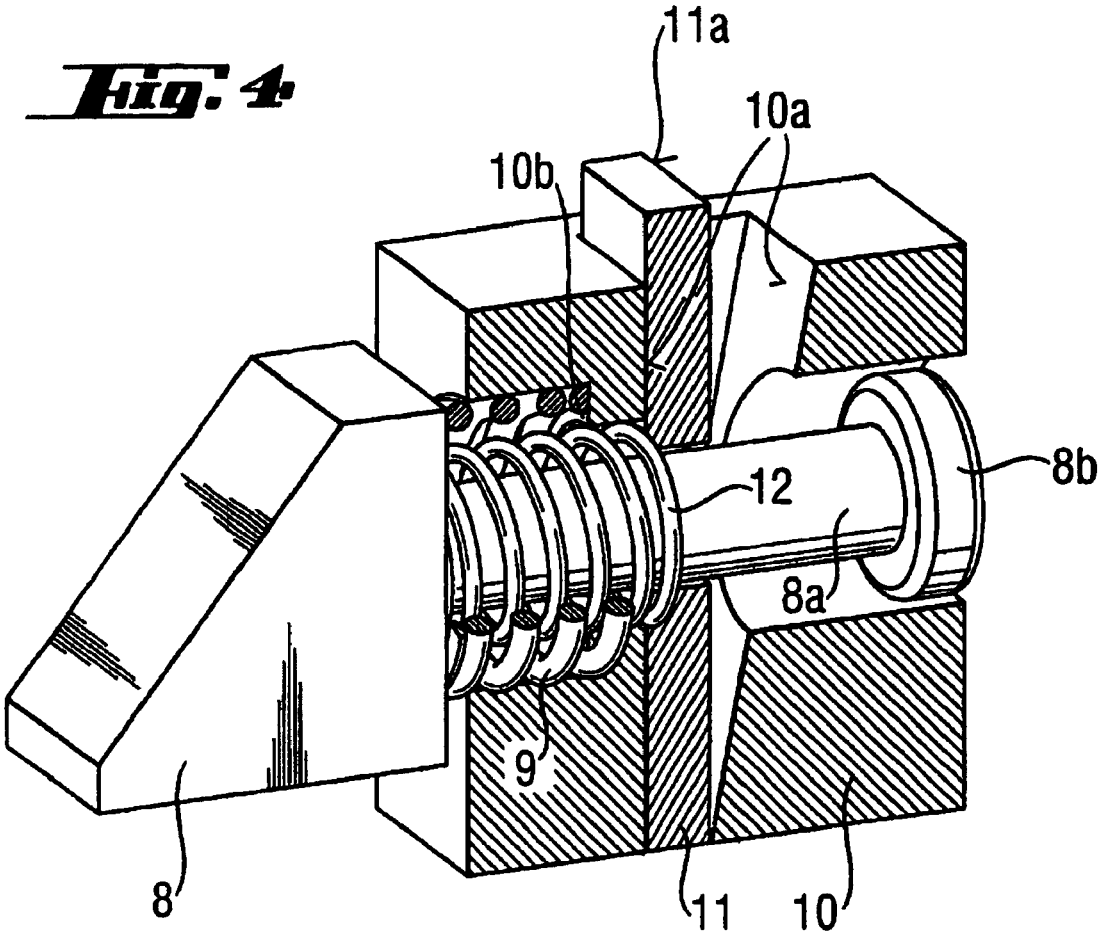
FIG. 4 shows a partial enlargement of FIG. 3, partly in section, and as perspective view taken on line IV-IV.

In the situation according to FIGS. 3 and 4 only the auxiliary bolt is pressed into the lock case. In this case both springs 9 and 12 yield, but the stop member 11 keeps the guide element 7 still in its upper, non-deadlocking position, whereby the door may still be pushed to its closed position without any operational means.

Figure 5:
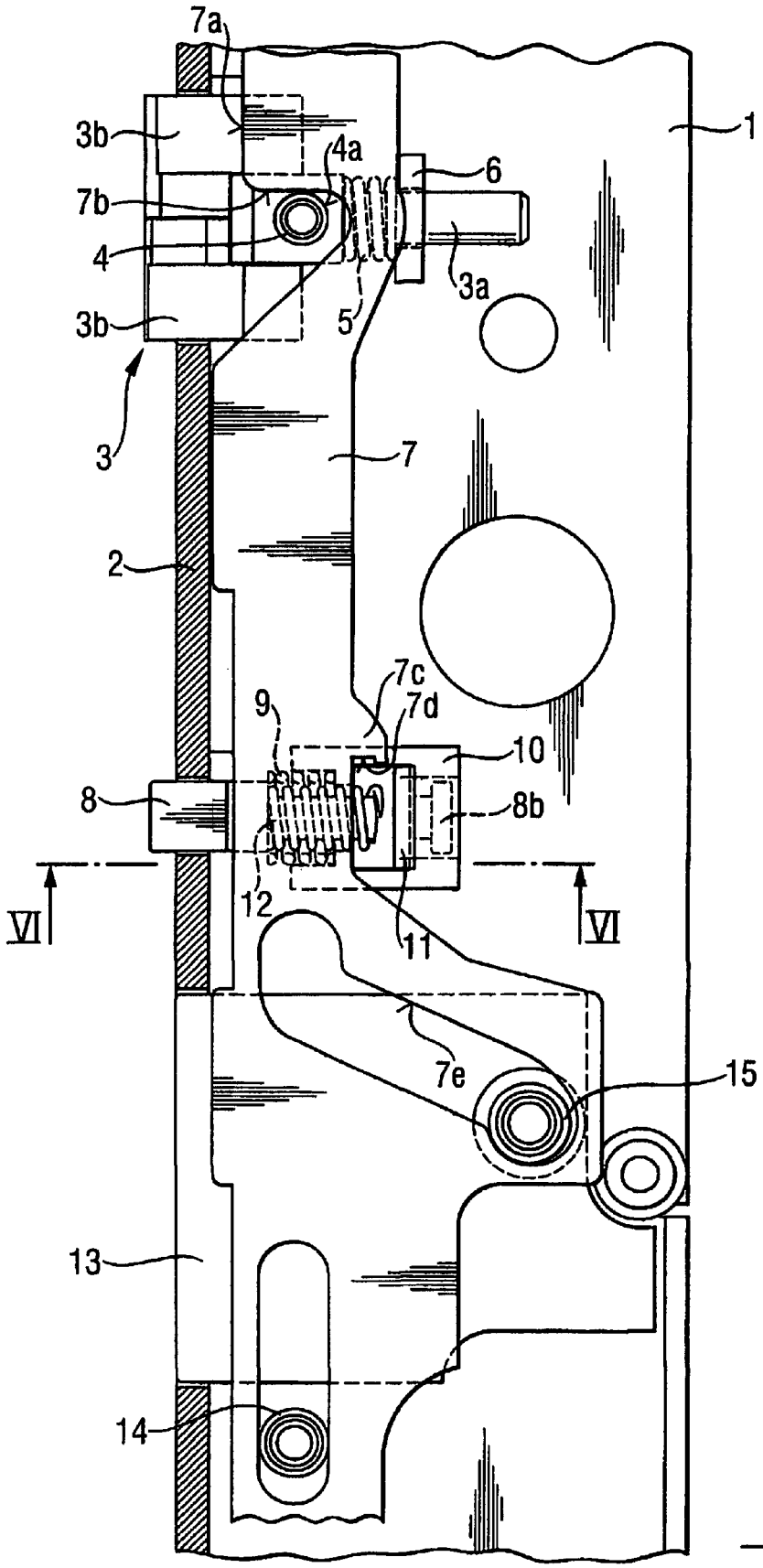
FIG. 5 shows the arrangement according to FIG. 1 in a situation where both the latch bolt and the auxiliary bolt are pressed into the lock case.
Figure 6:
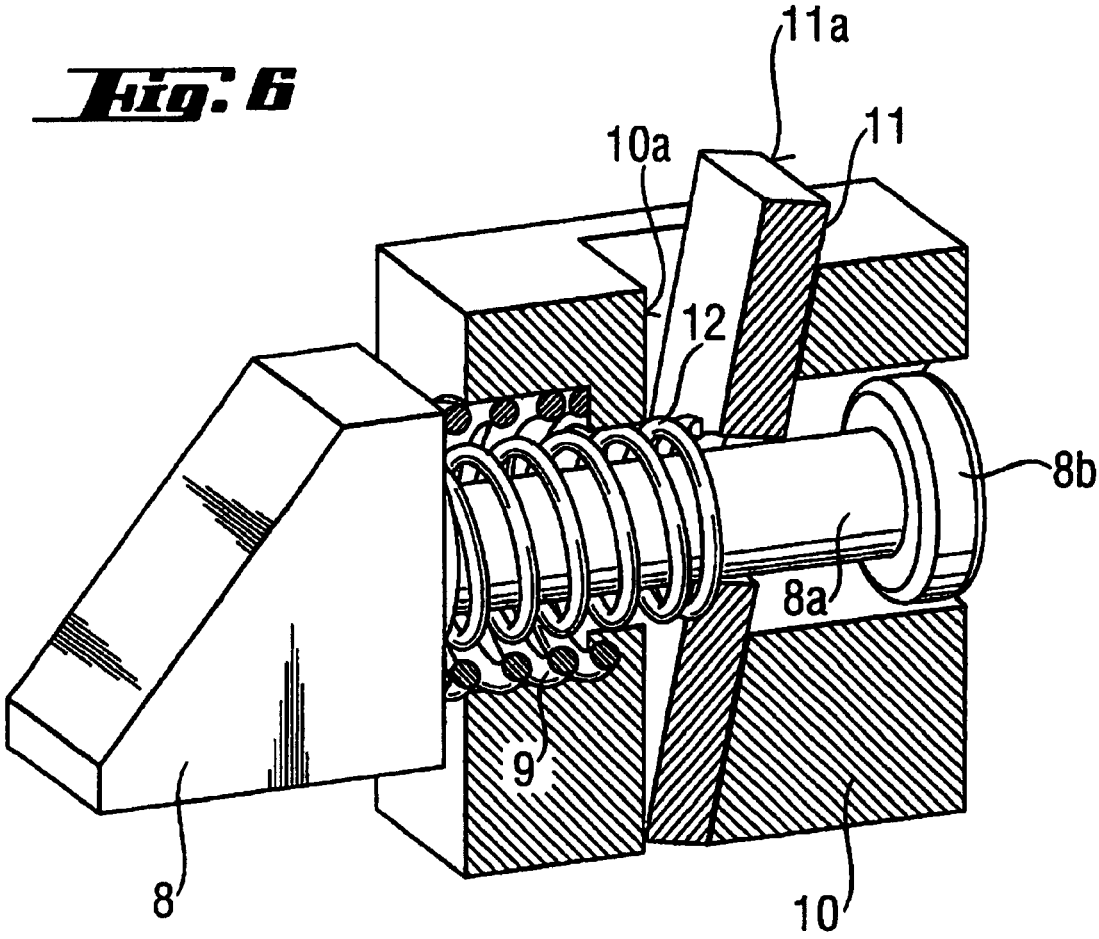
FIG. 6 shows a partial enlargement of FIG. 5, partly in section, and as perspective view taken on line VI-VI.

FIGS. 5 and 6 show a situation where both the latch bolt 3 and the auxiliary bolt 8 are pressed into the lock case 1, which relates to pushing the door to its closed position. Thus, at the same time as the latch bolt 3 moves inwards, the guide surface 4*a* included therein hits the counter surface 7*b* of the guide element and moves the guide element 7 somewhat upwards in the figures so that the stop member 11 is released from the impact of the recess 7*d* and turns, urged by the spring 12, to the position illustrated in FIGS. 5 and 6.

Figure 8:
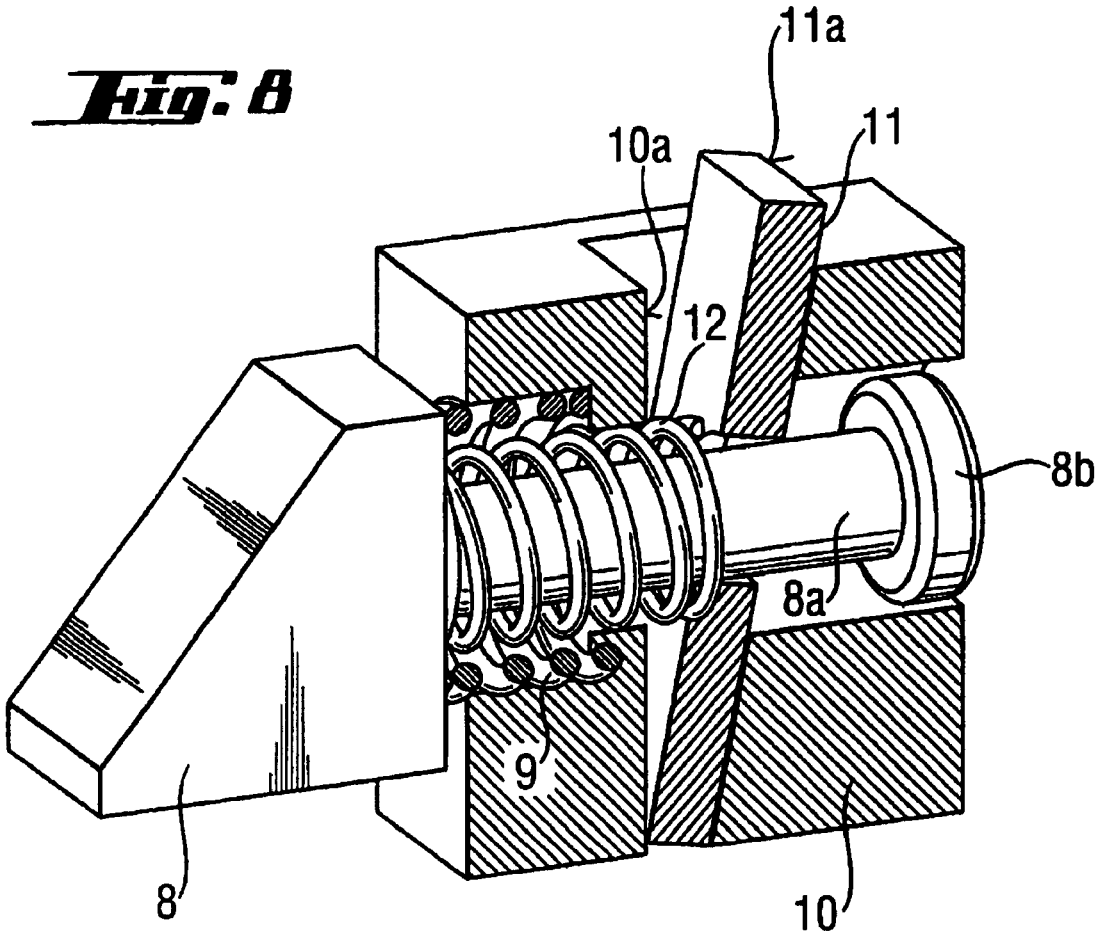
FIG. 8 shows a partial enlargement of FIG. 7, partly in section, and as perspective view taken on line VIII-VIII.

After this, when the door is completely closed, the latch bolt 3 is allowed to move into the bolt opening (not shown) in the striker plate of the lock in the doorframe, but the striker plate prevents the protrusion of the auxiliary bolt 8. This corresponds to the situation in FIGS. 7 and 8. At the same time as the latch bolt 3 is moved out, the stop face 7*b* of the guide element is released from the impact of the guide surface 4*a* of the latch bolt 3. Since the stop member 11 is still urged by the spring 12 to its turned position shown in FIGS. 5-8, the guide element 7 is allowed to move to its lower position shown in FIGS. 7 and 8, where it provides the deadlocking of the latch bolt 3 by means of its guide surface 7*a*. If the aim is to open the door, it requires moving of the guide element 7 again to its upper position according to FIGS. 1 and 2, which can be accomplished by several ways known per se, for instance by a door handle, by a key, or electrically. As it appears from the figures also the dead bolt 13 is then movable by means of the guide groove 7*e* in the guide element 7 to its retracted position enabling the opening of the door.

The invention is not limited to the above-described application, but several modifications are conceivable in the scope of the appended claims.

The invention claimed is:

1. A door lock comprising:

a lock case, a latch bolt having a body part at least partly within the lock case and at least one outwardly tapering wedge-shaped headpiece pivotably supported by the body part and extending at least partly from the lock case so that the latch bolt may be pressed into the lock case from either side thereof in the direction of door opening or closing due to a force acting upon said at least one wedge-shaped headpiece, a first spring urging the latch bolt to a position protruding from the lock case, an auxiliary bolt, a second spring urging the auxiliary bolt to a position protruding from the lock case, a guide element which is movable relative to the lock case between a position in which it provides deadlocking of the latch bolt and a position in which it permits the latch bolt to be pressed into the lock case to its retracted position, and a stop member supported by the auxiliary bolt, which stop member is movable relative to the auxiliary bolt between a position in which the stop member acts upon the guide element and prevents the guide element moving to the position providing deadlocking of the latch bolt, while the auxiliary bolt is in its protruding position, and a position in which the stop member allows the guide element to move to its position providing the deadlocking of the latch bolt, and wherein the stop member is urged by a spring to the position in which it allows the guide element to move and the stop member allows the guide element to move to the position providing deadlocking of the latch bolt only in case both the auxiliary bolt and the latch bolt are first moved to their retracted positions.

2. A door lock according to claim 1, comprising a guiding piece attached to the lock case, which guiding piece limits movement of the stop member and guides movement of the auxiliary bolt.

3. A door lock according to claim 1, wherein the guide element has an abutment surface that is engaged by the stop member when the stop member prevents the guide element moving to the position providing deadlocking of the latch bolt and the guide element has a protrusion that prevents the stop member moving clear of said abutment surface while the latch bolt and the auxiliary bolt are in their protruding positions.

4. A door lock according to claim 3, wherein the latch bolt has a guide surface which engages the guide element for moving the guide element so as to release the stop member from said recess when the latch bolt is pressed into the lock case.

5. A door lock according to claim 1, wherein the guide element is formed with a recess in which the stop member is located when the stop member is in the position in which it prevents the guide element moving to the position providing deadlocking of the latch bolt, and the guide element has a protrusion that prevents movement of the stop member from the location in the recess while the latch bolt and the auxiliary bolt are in their protruding positions.

6. A door lock according to claim 1 further comprising a dead bolt, and wherein said guide element cooperates with the dead bolt to guide movement of the dead bolt between a protruding position and a retracted position.

7. A door look comprising:

a look case, a latch bolt having a body part at least partly within the lock case and at least one outwardly tapering wedge-shaped headpiece pivotably supported by the body part and extending at least partly from the lock case so that the latch bolt may be pressed into the lock case from either side thereof in the direction of door opening or closing due to a force acting upon said at least one wedge-shaped headpiece, a first spring urging the latch bolt to a position protruding from the lock case, an auxiliary bolt, a second spring urging the auxiliary bolt to a position protruding from the lock case, a guide element which is movable relative to the lock case between a position in which it provides deadlocking of the latch bolt and a position in which it permits the latch bolt to be pressed into the lock case to its retracted position, a stop member supported by the auxiliary bolt, which stop member is movable relative to the auxiliary bolt between a position in which the stop member acts upon the guide element and prevents the guide element moving to the position providing deadlocking of the latch bolt, while the auxiliary bolt is in its protruding position, and a position in which the stop member allows the guide element to move to its position providing the deadlocking of the latch bolt, and a guiding piece attached to the lock case, which guiding piece limits movement of the stop member and guides movement of the auxiliary bolt, and wherein the stop member is turnable relative to said guiding piece and has a guiding edge which cooperates with the guide element, and the stop member allows the guide element to move to the position providing deadlocking of the latch bolt only in case both the auxiliary bolt and the latch bolt are first moved to their retracted positions.

8. A door lock according to claim 7, wherein the guiding piece has mutually inclined guide surfaces between which the stop member is located.

9. A door lock comprising:

a lock case, a latch bolt having a body part at least partly within the lock case and at least one outwardly tapering wedge-shaped headpiece pivotably supported by the body part and extending at least partly from the lock case so that the latch bolt may be pressed into the lock case from either side thereof in the direction of door opening or closing due to a force acting upon said at least one wedge-shaped headpiece, a first spring urging the latch bolt to a position protruding from the lock case, an auxiliary bolt, a second spring urging the auxiliary bolt to a position protruding from the lock case, a guide element which is movable relative to the lock case between a position in which it provides deadlocking of the latch bolt and a position in which it permits the latch bolt to be pressed into the lock case to its retracted position, and a stop member supported by the auxiliary bolt, which stop member is movable relative to the auxiliary bolt between a position in which the stop member acts upon the guide element and prevents the guide element moving to the position providing deadlocking of the latch bolt, while the auxiliary bolt is in its protruding position, and a position in which the stop member allows the guide element to move to its position providing the deadlocking of the latch bolt, and wherein the stop member allows the guide element to move to the position providing deadlocking of the latch bolt only in case both the auxiliary bolt and the latch bolt are first moved to their retracted positions, the guide element has an abutment surface that is engaged by the stop member when the stop member prevents the guide element moving to the position providing deadlocking of the latch bolt, the guide element has a protrusion that prevents the stop member moving clear of said abutment surface while the latch bolt and the auxiliary bolt are in their protruding positions, the protrusion bounds a recess in which the top member is retained when in engages the abutment surface, the latch bolt has a guide surface which engages the guide element for moving the guide element so as to release the stop member from said recess when the latch bolt is pressed into the lock case, the latch bolt includes a deadlocking member that the guide element acts upon in order to provide deadlocking of the latch bold, and said guide surface is a surface of the deadlocking member.

10. A door lock comprising:

a lock case, a latch bolt movable relative to the lock case against spring force from a protruding position to a retracted position, an auxiliary bolt movable relative to the lock case against spring force from a protruding position to a retracted position, a guide element which is movable relative to the lock case between a position in which it provides deadlocking of the latch bolt and a position in which it permits the latch bolt to move freely between its protruding position and its retracted position, and a stop member supported by the auxiliary bolt, which stop member turns relative to the lock case between a first position in which the stop member acts upon the guide element and prevents the guide element moving to the position providing deadlocking of the latch bolt, while the auxiliary bolt is in its protruding position, and a second position in which the stop member allows the guide element to move to the position providing deadlocking of the latch bolt, and wherein if the latch bolt is in its protruding position the guide element may assume a position intermediate the position in which it provides deadlocking of the latch bolt and the position in which it permits the latch bolt to move freely between its protruding position and its retracted position, in said intermediate position the guide element prevents the stop member moving from the first position to the second position, and in the event that the latch bolt is pressed into the lock case to its retracted position while the guide element is in its intermediate position the guide element is moved to the position in which it permits the latch bolt to move freely between its protruding position and its retracted position, whereby upon sequentially moving the latch bolt to its retracted position, moving the auxiliary bolt to its retracted position, and moving the latch bolt to its protruding position, the guide element can move to the position in which it provides deadlocking of the latch bolt.

11. A door lock according to claim 10, wherein the guide element includes a body part and a protrusion that projects from the body part and abuts the stop member when the guide element is in the intermediate position and the stop member is in the first position, whereby the stop member prevents the guide element moving to the position providing deadlocking of the latch bolt, and in the event that the stop member is in the second position, the stop member is clear of the protrusion and allows the guide element to move to the position providing deadlocking of the latch bolt.

12. A door lock according to claim 11, wherein the protrusion of the guide element includes a retaining part that prevents the stop member moving from the first position to the second position in the event that the guide element is in the intermediate position.

13. A door lock according to claim 10, wherein the latch bolt includes a deadlocking member that engages the guide element when the guide element is in the position providing deadlocking of the latch bolt and whereby the guide element provides deadlocking of the latch bolt.

14. A door lock according to claim 13, wherein in the event that the latch bolt is pressed into the lock case while the guide element is in its intermediate position, the deadlocking member of the latch bolt engages the guide element and moves the guide element to the position in which it permits the latch bolt to move freely between its protruding position and its retracted position.

15. A door lock according to claim 10, further comprising a dead bolt movable relative to the lock case between a protruding position and a retracted position, and wherein the guide element cooperates with the dead bolt for moving the dead bolt between its retracted position and its protruding position.

16. A door lock comprising:

a lock case, a latch bolt movable relative to the lock case against spring force from a protruding position to a retracted position, an auxiliary bolt movable relative to the lock case against spring force from a protruding position to a retracted position, a guide element which is movable relative to the lock case between a position in which it provides deadlocking of the latch bolt and a position in which it permits the latch bolt to move freely between its protruding position and its retracted position, a stop member supported by the auxiliary bolt, which stop member is movable relative to the auxiliary bolt between a first position in which the stop member acts upon the guide element and prevents the guide element moving to the position providing deadlocking of the latch bolt, while the auxiliary bolt is in its protruding position, and a second position in which the stop member allows the guide element to move to the position providing deadlocking of the latch bolt, and a spring urging the stop member from the first position to the second position, and wherein if the latch bolt is in its protruding position the guide element may assume a position intermediate the position in which it provides deadlocking of the latch bolt and the position in which it permits the latch bolt to move freely between its protruding position and its retracted position, in said intermediate position the guide element prevents the stop member moving from the first position to the second position, and in the event that the latch bolt is pressed into the lock case to its retracted position while the guide element is in its intermediate position the guide element is moved to the position in which it permits the latch bolt to move freely between its protruding position and its retracted position, whereby upon sequentially moving the latch bolt to its retracted position, moving the auxiliary bolt to its retracted position, and moving the latch bolt to its protruding position, the guide element can move to the position in which it provides deadlocking of the latch bolt.

* * * * *